US005977049A

United States Patent [19]

Briceno et al.

[11] Patent Number: 5,977,049

[45] Date of Patent: Nov. 2, 1999

[54] CARBANILIDE ANTIBACTERIAL COMPOSITION

[75] Inventors: Laura B. Briceno, Perth Amboy; Nadia A. Soliman, East Brunswick, both of N.J.

[73] Assignee: Colgate-Palmolilve Co., New York, N.Y.

[21] Appl. No.: 08/903,404

[22] Filed: Jul. 30, 1997

[51] Int. Cl.[6] ..... C11D 1/83; C11D 3/48

[52] U.S. Cl. ..... 510/387; 510/130; 510/131; 510/159; 510/382; 510/383; 510/386; 510/388; 514/586

[58] Field of Search ..... 424/49, 52, 54; 510/382, 383, 387, 388, 424, 427, 422, 131, 159, 130, 386; 514/586

[56] References Cited

U.S. PATENT DOCUMENTS

| | | | |
|---|---|---|---|
| 3,770,642 | 11/1973 | Jungermann et al. | 252/107 |
| 5,632,978 | 5/1997 | Moore et al. | 510/159 |
| 5,661,189 | 8/1997 | Grieveson et al. | 514/784 |

FOREIGN PATENT DOCUMENTS

| | | |
|---|---|---|
| 63-139998 | 6/1988 | Japan . |
| 1244809 | 9/1971 | United Kingdom . |

OTHER PUBLICATIONS

Croda, Product Guide Second Edition, Apr. 1990, cover p. 14.

Monsanto, Jul. 1992, pp. 1–9.

Hunting, Encyclopedia of Shampoo Ingredients, 1985, p. 269.

Protameen Chemicals Inc., Cosmetics & Personal Care Raw Materials Catalog, No Date Known, p. 2.

Croda, Product Guide, Apr. 1990, p. 14.

Monsanto Communication, Jul. 1992, pp. 1–9.

Wackherr, Solubilisant LRI, 1995, pp. 1–15.

*Primary Examiner*—Margaret Einsmann
*Assistant Examiner*—Gregory E. Webb
*Attorney, Agent, or Firm*—Martin B. Barancik

[57] ABSTRACT

An aqueous liquid composition comprising a) an anionic surfactant or mixtures thereof in cleansing effective quantities, b) a primary ethoxylated alcohol of the structure $R(OCH_2CH_2)_nOH$ wherein R is an average alkyl of about 10 to about 14 carbon atoms, inclusive, and n is an average number of about 6 to about 10, c) a carbanilide antibacterial agent present in an antibacterial effective amount but no more than about 2 wt. % of the composition, the quantity of component c being in a wt. ratio to component b of about 1 to 6 to about 1 to 15, and d) the balance being water.

23 Claims, No Drawings

CARBANILIDE ANTIBACTERIAL COMPOSITION

BACKGROUND OF THE INVENTION

Antibacterial agents have been placed into cleansing compositions for many years. However, not all antibacterial agents are active or present stable entities in specific cleansing compositions. Some antibacterial agents are easier to stabilize and maintain activity in solid compositions. Other antibacterial agents more readily maintain activity and stability in liquid cleansing compositions. Antibacterial agents of the carbanilide family are well known to be difficult to solubilize and also to stabilize in liquid systems, particularly aqueous liquid systems. The most well known of these carbanilide antibacterial agents is triclocarban.

A composition which has easily solubilizable carbanilide antibacterial effective amounts and which is also stable has now been discovered. The system is aqueous. The system remains preferably clear as shown by the appropriately solubilized carbanilide antibacterial agent. The solubilization can be done at room temperature. The composition remains stable for extended periods of time. The carbanilide antibacterial agent is deposited on the skin as an antibacterial active agent.

SUMMARY OF THE INVENTION

In accordance with the invention there is an aqueous liquid composition comprising a) an anionic surfactant in cleansing effective quantities, b) a primary ethoxylated alcohol of the structure $R(OCH_2CH_2)_nOH$ wherein R is an alkyl of about 10 to about 14 carbon atoms and n is an average number of 6 to 10 in carbanilide stabilizing and solubilizing effective quantities, c) a carbanilide antibacterial agent present in an antibacterial effective amount but no more than about 2 wt. % of the composition, the quantity of component c being in a weight ratio to component b of about 1 to about 6 to about 1 to about 15, and d) the balance being water.

Additionally, there is a composition which comprises from about 6 to about 14 wt. % carbanilide active agent, and the remainder being $R(OCH_2CH_2)_nOH$ wherein R is an alkyl of about 10 to 14 carbon atoms, inclusive, and n is an average number of about 6 to 10.

DETAILED DESCRIPTION OF THE INVENTION

Any anionic surfactant can be employed. Examples of such anionic surfactants include soap, a long chain alkyl or alkenyl, branched or normal carboxylic acid salt such as sodium, potassium, ammonium or substituted ammonium salt, can be present in the composition. Exemplary of long chain alkyl or alkenyl are from about 8 to about 22 carbon atoms in length, specifically about 10 to about 20 carbon atoms in length, more specifically alkyl and most specifically normal, or normal with little branching. Small quantities of olefinic bond(s) may be present in the predominantly alkyl sections, particularly if the source of the "alkyl" group is obtained from a natural product such as tallow, coconut oil and the like. Anionic nonsoap surfactants can be exemplified by the alkali metal salts of organic sulfate having in their molecular structure an alkyl radical containing from about 8 to about 22 carbon atoms and a sulfonic acid or sulfuric acid ester radical (included in the term alkyl is the alkyl portion of higher acyl radicals). Preferred are the sodium, ammonium, potassium or triethanolamine alkyl sulfates, especially those obtained by sulfating the higher alcohols ($C_8$–$C_{18}$ carbon atoms), sodium coconut oil fatty acid monoglyceride sulfates and sulfonates; sodium or potassium salts of sulfuric acid esters of the reaction product of 1 mole of a higher fatty alcohol (e.g., tallow or coconut oil alcohols) and 1 to 12 moles of ethylene oxide; sodium or potassium salts of alkyl phenol ethylene oxide ether sulfate with 1 to 10 units of ethylene oxide per molecule and in which the alkyl radicals contain from 8 to 12 carbon atoms, sodium alkyl glyceryl ether sulfonates; the reaction product of fatty acids having from 10 to 22 carbon atoms esterified with isethionic acid and neutralized with sodium hydroxide; water soluble salts of condensation products of fatty acids with sarcosine; and others known in the art for example taurates, phosphate, and those listed in the *Mr. Cutcheon's Encyclopedia of Surfactants.*

Although not necessary other surfactants may be present in the composition. Examples of these surfactants include zwitterionic surfactants can be exemplified by those which can be broadly described as derivatives of aliphatic quaternary ammonium, phosphonium, and sulfonium compounds, in which the aliphatic radicals can be straight chain or branched and wherein one of the aliphatic substituents contains from about 8 to 18 carbon atoms and one contains an anionic water-solubilizing group, e.g., carboxy, sulfonate, sulfate, phosphate, or phosphonate. A general formula for these compounds is:

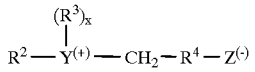

wherein $R^2$ contains an alkyl, alkenyl, or hydroxy alkyl radical of from about 8 to about 18 carbon atoms, from 0 to about 10 ethylene oxide moieties and from 0 to I glyceryl moiety; Y is selected from the group consisting of nitrogen, phosphorus, and sulfur atoms; $R^3$ is an alkyl or monohydroxyalkyl group containing 1 to about 3 carbon atoms; X is I when Y is a sulfur atom and 2 when Y is a nitrogen or phosphorus atom, $R^4$ is an alkylene or hydroxyalkylene of from 0 to about 4 carbon atoms and Z is a radical selected from the group consisting of carboxylate, sulfonate, sulfate, phosphonate, and phosphate groups.

Examples include: 4-[N,N-di(2-hydroxyethyl)-N-octadecylammonio]-butane-1-carboxylate; 5-[S-3-hydroxypropyl-S-hexadecylsulfonio] -3 hydroxypentane-1-sulfate; 3-[P,P-P-diethyl-P 3,6,9 trioxatetradecylphosphonio]-2-hydroxypropane-1-phosphate; 3-[N,N-dipropyl-N-3 dodecoxy-2-hydroxypropylammonio]-propane-1-phosphonate; 3-(N,N-di- methyl-N-hexadecylammonio) propane-1-sulfonate; 3-(N,N-dimethyl-N-hexadecylammonio)-2-hydroxypropane-1-sulfonate; 4-(N,N-di(2-hydroxyethyl)-N-(2 hydroxydodecyl) ammonio]-butane-1-carboxylate; 3-[S-ethyl-S-(3-dodecoxy-2-hydroxypropyl)sulfonio]-propane-1-phosphate; 3-(P,P-dimethyl-P-dodecylphosphonio)-propane-1-phosphonate; and 5-[N,N-di(3-hydroxypropyl)-N-hexadecylammonio]-2-hydroxy-pentane-1-sulfate.

Examples of amphoteric surfactants which can be used in the compositions of the present invention are those which can be broadly described as derivatives of aliphatic secondary and tertiary amines in which the aliphatic radical can be straight chain or branched and wherein one of the aliphatic substituents contains from about 8 to about 18 carbon atoms and one contains an anionic water solubilizing group, e.g., carboxy, sulfonate, sulfate, phosphate, or phosphonate. Examples of compounds falling within this definition are sodium 3-dodecylaminopropionate, sodium 3-dodecylaminopropane sulfonate, N-alkyltaurines, such as the one prepared by reacting dodecylamine with sodium isethionate according to the teaching of U.S. Pat. No. 2,658,072, N-higher alkyl aspartic acids, such as those produced according to the teaching of U.S. Pat. No. 2,438,091, and the products sold under the trade name "Miranol" and described in U.S. Pat. No. 2,528,378. Other amphoterics such as betaines are also useful in the present composition.

Examples of betaines useful herein include the high alkyl betaines such as coco dimethyl carboxymethyl betaine, lauryl dimethyl carboxy-methyl betaine, lauryl dimethyl alpha-carboxyethyl betaine, cetyl dimethyl carboxymethyl betaine, lauryl bis-(2-hydroxyethyl)carboxy methyl betaine, stearyl bis-(2-hydroxypropyl) carboxymethyl betaine, oleyl dimethyl gamma-carboxypropyl betaine, lauryl bis-(2-hydro-xypropyl) alpha-carboxyethyl betaine, etc. The sulfobetaines may be represented by coco dimethyl sulfopropyl betaine, stearyl dimethyl sulfopropyl betaine, amido betaines, amidosulfobetaines, and the like.

Many cationic surfactants are known to the art. By way of example, the following may be mentioned:

stearyldimenthylbenzyl ammonium chloride;

dodecyltrimethylammonium chloride;

nonylbenzylethyldimethyl ammonium nitrate;

tetradecylpyridinium bromide;

laurylpyridinium chloride;

cetylpyridinium chloride laurylpyridinium chloride;

laurylisoquinolium bromide;

ditallow(Hydrogenated)dimethyl ammonium chloride;

dilauryldimethyl ammonium chloride; and stearalkonium chloride.

Additional cationic surfactants are disclosed in U.S. Pat. No. 4,303,543 see column 4, lines 58 and column 5, lines 1–42, incorporated herein by references. Also see *CTFA Cosmetic Ingredient Dictionary* 4*th Edition* 1991, pages 509–514 for various long chain alkyl cationic surfactants; incorporated herein by references.

Nonionic surfactants can be broadly defined as compounds produced by the condensation of alkylene oxide groups (hydrophilic in nature) with an organic hydrophobic compound, which may be aliphatic or alkyl aromatic in nature. Examples of preferred classes of nonionic surfactants are:

1. The polyethylene oxide condensates of alkyl phenols, e.g., the condensation products of alkyl phenols having an alkyl group containing from about 6 to 12 carbon atoms in either a straight chain or branched chain configuration, with ethylene oxide, the said ethylene oxide being present in amounts equal to 10 to 60 moles of ethylene oxide per mole of alkyl phenol. The alkyl substituent in such compounds may be derived from polymerized propylene, diisobutylene, octane, or nonane, for example.

2. Those derived from the condensation of ethylene oxide with the product resulting from the reaction of propylene oxide and ethylene diamine products which may be varied in composition depending upon the balance between the hydrophobic and hydrophilic elements which is desired. For example, compounds containing from about 40% to about 80% polyoxyethylene by weight and having a molecular weight of from about 5,000 to about 11,000 resulting from the reaction of ethylene oxide groups with a hydrophobic base constituted of the reaction product of ethylene diamine and excess propylene oxide, said base having a molecular weight of the order of 2,500 to 3,000, are satisfactory.

3. The condensation product of aliphatic alcohols having from 8 to 18 carbon atoms, in either straight chain or branched chain configuration with ethylene oxide, e.g., a coconut alcohol ethylene oxide condensate having from 10 to 30 moles of ethylene oxide per mole of coconut alcohol, the coconut alcohol fraction having from 10 to 14 carbon atoms. Other ethylene oxide condensation products are ethoxylated fatty acid esters of polyhydric alcohols (e.g., Tween 20-polyoxyethylene (20) sorbitan monolaurate).

4. Long chain tertiary amine oxides corresponding to the following general formula:

$$R_1R_2R_3N\rightarrow 0$$

wherein $R_1$ contains an alkyl alkenyl or monohydroxy alkyl radical of from about 8 to about 18 carbon atoms, from 0 to about 10 ethylene oxide moieties, and from 0 to 1 glyceryl moiety, and, $R_2$ and $R_3$ contain from 1 to about 3 carbon atoms and from 0 to about 1 hydroxy group, e.g., methyl, ethyl, propyl, hydroxy ethyl, or hydroxy propyl radicals. The arrow in the formula is a conventional representation of a semipolar bond. Examples of amine oxides suitable for use in this invention include dimethyldodecylamine oxide, oleyl-di(2-hydroxyethyl) amine oxide, dimethyloctylamine oxide, dimethyldecylamine oxide, dimethyltetradecylamine oxide, 3,6,9 trioxaheptadecyldiethylamine oxide, di(2-hydroxyethyl)-tetradecylamine oxide, 2-dodecoxyethyldimethylanine oxide, 3-dodecoxy-2-hydroxypropyldi(3-hydroxypropyl)amine oxide, dimethylhexadecylamine oxide.

5. Long chain tertiary phosphine oxides corresponding to the following general formula:

$$RR'R''P\rightarrow 0$$

wherein R contains an alkyl alkenyl or monohydroxyalkyl radical ranging from 8 to 20 carbon atoms in chain length, from 0 to about 10 ethylene oxide moieties and from 0 to 1 glyceryl moiety and R' and R" are each alkyl or monohydroxyalkyl groups containing from 1 to 3 carbon atoms. The arrow in the formula is a conventional representation of a semipolar bond. Examples of suitable phosphine oxides are: dodecyldimethylphosphine oxide, tetradecylmethylethylphosphine oxide, 3,6,9-trioxaoctadecyldimethylphosphine oxide, cetyldimethylphosphine oxide, 3-dodecoxy-2-hydroxypropyldi(2-hydroxyethyl) phosphine oxide stearyldimethylphosphine oxide, cetylethyl propylphosphine oxide, oleyldiethylphosphine oxide, dodecyldiethylphosphine oxide, tetradecyldiethylphosphine oxide, dodecyldipropylphosphine oxide, dodecyldi(hydroxymethyl) phosphine oxide, dodecyldi(2-hydroxyethyl)phosphine oxide, tetradecylmethyl-2-hydroxypropylphosphine oxide, oleyldimethylphosphine oxide, 2-hydroxydodecyldimethylphosphine oxide.

6. Long chain dialkyl sulfoxides containing one short chain alkyl or hydroxy alkyl radical of 1 to about 3 carbon atoms (usually methyl) and one long hydrophobic chain which contain alkyl, alkenyl, hydroxy alkyl, or keto alkyl radicals containing from about 8 to about 20 carbon atoms, from 0 to about 10 ethylene oxide moieties and from 0 to 1 glyceryl moiety. Examples include: octadecyl methyl sulfoxide, 2-ketotridecyl methyl sulfoxide, 3,6,9-trioxaoctadecyl 2-hydroxyethyl sulfoxide, dodecyl methyl sulfoxide, oleyl 3-hydroxypropyl sulfoxide, tetradecyl methyl sulfoxide, 3 methoxytridecylmethyl sulfoxide, 3-hydroxytridecyl methyl sulfoxide, 3-hydroxy-4dodecoxybutyl methyl sulfoxide.

Present in the composition should be a carbanilide antibacterial agent in an effective amount to bring about antibacterial action. Examples of the carbanilide antibacterial family include various diphenylanilide preferably having halo substituent(s) on the ring, see Colwell, U.S. Pat. No. 5,496,555. Particularly preferred is the antibacterial carbanilide well known as triclocarban, CAS #101-20-2. Triclocarban is also known as n-(4-chlorophenyl)-n(3,4-dichlorophenyl) urea. Its more trivial name is 3,4,4-trichlorocarbanilide.

It has now been found that these antibacterial agents, particularly trichlorocarban, can be effectively solubilized and stabilized in an aqueous liquid cleansing composition through the use of a compound of the structure $R(OCH_2CH_2)_nOH$ wherein R is an alkyl of about 10 to about 14 carbon atoms and n is an average number of about 6 to 10. Preferably R is 12 carbon atoms and n is the average number 7 or 9. When using these long-chain ethoxylated primary alcohols, particularly lauryl alcohol with 7 or 9 average ethoxy groups therein, and more particularly the lauryl alcohol with 7 average ethoxy groups, the carbanilide antibacterial agent can be effectively solubilized. This can be done at room temperature. Although no additional heat is necessary, temperature up to about 50° C. can hasten the solubilization. This is contrary to most of the other potential solubilizing agents which require heating to 90° C. or even higher in some cases. Additionally, the clarity of the aqueous cleansing composition can be preferably maintained and the viscosity of the cleansing composition is also maintainable within the desired range of centipoise. Generally, this desired viscosity is one that will allow for easy pouring or hand pumping of the cleansing composition from a container. The viscosity range in centipoise (cps) is generally from about 2000 to about 15,000 as measured on a Brookfield RVTD viscometer using a spindle 5 at room temperature and 20 rpms. Interestingly the viscosity can vary depending upon the number of the ethoxy groups present in the lauryl alcohol. Laureth 9 provides a viscosity of approximately about 700 cps to about 2,000 when present in the finished cleansing composition. This cps can be readily raised through the addition of known thickeners such as salts, polyacrylamides and the like, preferably table salt. However, laureth 7 provides a higher viscosity initially and when used in the overall composition, provides a viscosity of about 3000 to about 7000 cps depending upon the quantity of laureth 7 employed. If a lower viscosity for the final composition is required, this can be readily obtained by adding a viscosity reducing agent such as block polymers of polyoxyethene and polyoxypropylene known as Poloxamers. Poloxamer 184 is preferred. The quantity of viscosity reducing agent employed is dependent upon the final desired viscosity.

The quantity of the long-chain ethoxylated alcohol necessary to bring about the solubilization and stabilization of the antibacterial agent is generally from about 6 times to about 15 times the wt. % of the antibacterial agent employed preferably about 7 to about 12 times. With respect to the carbanilide antibacterial agents, particularly triclocarban, the quantity of antibacterial agent should not exceed 2 wt. % of the cleansing composition and is generally from about 0.1 to about 1.5 wt. % of the cleasing composition preferably about 0.15 to about 1.0 wt. %. The wt. % for the long-chain primary ethoxylated alcohol employed is generally from about 0.6 to about 12 wt. % of the cleansing composition, although somewhat larger amounts of the alcohol can be employed.

With respect to the other components of the cleansing composition, the major quantity of the composition is water. The anionic surfactant or mixtures thereof can be present in quantities from about 3 wt. % to about 30 wt. % of the cleansing composition.

Other minimum quantities such as 4, 5, 6, 8 or 10 wt. % can be employed; maximal quantities of about 15, 20 or 25 wt. % can also be employed. The quantity of the surfactant should be sufficient to bring about a lather and cleanse skin when applied under appropriate lathering conditions. Although not necessary, a clear composition can be obtained. Other surfactants may also be present, generally the betaine and nonionic surfactants are preferred. The betaines can belong to any of the general betaine family as understood by definitions in the *Cosmetic Toiletry and Fragrance Association Ingredient Dictionary* (CTFA, 4th Edition). Generally the milder betaines are preferred such as the long-chain amido betaines, particularly cocoamidoethyl and cocoamidopropyl betaine. The quantity of betaine which can be present is generally from about 1 to about 12 wt. % of the composition, preferably from about 2 to about 10 wt. % of the composition. Additionally, it is preferred to use certain non-ionic surfactants other than the long-chain ethoxylated alcohols mentioned as component b of the claim. The most preferred of these are the alkylpolyglycoside commonly known as APGs. These materials are present in the composition from about 0.5 to about 10 wt. % preferably from about 0.75 to about 8 wt. % of the composition. Examples of such preferred APGs are decylpolyglycoside, laurylpolyglycoside, each with an average dp of about 1 to about 3, preferably about 1.4 to about 1.8.

Other materials may also be in the composition, for example, materials which would give good skin feel such as the polyquaterniums particularly polyquats 6 and 7 as defined in the above-noted CTFA ingredient dictionary. Antioxidants, preservatives, fragrances and the like may also be present. Generally the clarity of the inventive compositions is measured prior to the addition of these agents. Some of these agents may be sufficiently insoluble in the composition so as to create a potential hazy composition particularly fragrances, occlusive agents, pearlescents, and the like. Additionally, a hazy, translucent or even opaque composition can be desired for marketing purposes.

Various potential solubilizing materials for the carbanilides have been tried with these systems. As can be shown by the listing of these reagents and the observed results, see below, the positive attributes of the long-chain primary ethoxylated alcohol are highly unusual The "weight ratio" of Table 1 is the weight of solubilizing agent employed to the weight of TCC. The temperature is that necessary to bring about the solubilization of the TCC in the solubilizing agent in a reasonable time period when only the two components are together. In Table 1 below, the viscosity observation refers to the usage of the "solubilized" triclocarbanilide (TCC) in the overall composition of Example 1 and is the measured viscosity of Example 1 at 25° C. using a Brookfield viscometer with a number 5 spindle at 20 rpm. The clarity reported in Table 1 refers to Example 1 composition using 0.5 wt. % TCC with the particular solubilizing agent from Table 1 added to the formulation at the weight ratio to TCC shown in Table 1. Any quantity differences are made up by the percent of water present in the Example 1 composition.

TABLE 1

| Solubilizing Agent | TCC and Solubilizer Alone wt. Ratio | Temperature ° C. | Example 1 with TCC and Solubilizer Clarity | Viscosity |
|---|---|---|---|---|
| Poloxamer 184[a] | 20 | 90 | Clear | No buildup |
| PEG-7 Glyceryl Cocoate | 10 | 90 | ppt | Buildup |
| PEG-7 Glyceryl Cocoate | 20 | 90 | Clear | Buildup |
| PEG-7 Glyceryl Cocoate Plus Disodium Laureth Sulfosuccinate | 20 | 90 | Hazy | Buildup |
| Lauramide Diethanolamide | 14 | 90 | ppt | No Buildup |
| PPG-26-buteth-26 and PEG-40 | 4 | 90 | ppt | No Buildup |
| Hydrogenated Castor Oil | 10 | 90 | ppt | No Buildup |
| Polysorbate 20 | 20 | 90 | ppt | No Buildup |
| Polysorbate 80 | 20 | 90 | Clear | Low Buildup |
| PEG-40 Hydrogenated Castor Oil | 10 | 90 | ppt | No Buildup |
| PEG-40 Hydronated Castor Oil | 20 | 90 | Clear | No Buildup |
| PEG-60 Hydrogenated Castor Oil | 10 | 90 | ppt | No Buildup |
| PEG-60 Hydrogenated Castor Oil | 20 | 90 | ppt | No Buildup |
| PPG 28 buteth 35 | 10 | 90 | ppt | No Buildup |
| PPG 28 buteth 35 | 20 | 90 | ppt | No Buildup |
| PEG-6 Cocoamide | 10 | 90 | ppt | No Buildup |
| PEG-6 Cocoamide | 20 | 90 | ppt | No Buildup |
| Laureth-7 | 10 | RT | Clear | Buildup |
| Laureth-7 | 20 | RT | Clear | Buildup |
| Laureth-9 | 10 | RT | Clear | Buildup |
| Laureth-9 | 20 | RT | Clear | Buildup |

[a]Cosmetic, Toiletry and Fragrance Association, Inc. International Cosmetic Ingredient Dictionary, 4th Ed., pg. 448 for formula Below is the formulation whose viscosity was measured. Any difference in quantity of solubilizing agents was made by varying the water content.

EXAMPLE 1

| Component | Quantity wt. % |
|---|---|
| Solubilizing agent from Table 1 | Refer to Table 1 |
| Triclocarban | 0.5 |
| Sodium Laureth Sulfate 2EO | 8.0 |
| Cocoamidopropylbetaine | 3.0 |
| Decylpolyglucoside | 1.13 |
| Polyquaternium 7 | 0.04 |
| EDTA | 0.05 |
| Glycerine | 0.2 |
| Dibromodicyanobutane | 0.03 |
| Perfume | 0.65 |
| Citric Acid | 0.1 |
| Sodium Chloride | 0.6 |
| Deionized Water | QS |

The above-identified composition with 5 wt. % of laureth-9 and 12 wt. % of sodium laureth sulfate 2EO has a pH of about 5.5 and a viscosity at room temperature using a Brookfield viscometer with a number 5 spindle at 20 rpm of 4,120 centipoise.

It is interesting to note that the above-identified formulation can employ the most common thickening agent, salt, effectively. Salt is an ineffective thickening agent for a clear cleansing composition when solubilizing agents such as Poloxamer 184, Polysorbate 80 and PEG-40 Hydrogenated Castor Oil are employed. The ability to use salt over a substantially more expensive thickening agent such as a polyacrylate or polyacrylamide is clearly advantageous.

When clarity is mentioned, this parameter is measured by the naked eye and takes into account visible solid matter such as a precipitate (ppt), haziness, translucency, and the like. Although not a required attribute in the final formulation particularly where some degree of opacity is desired for the application, i.e., the presence of a pearlescent or opacifying agent is desired, clarity can be present in various desired applications.

The stability of the composition is measured by pH and viscosity over a period of time and temperature.

The above formulation having 0.5 wt. % TCC, 5 wt. % laureth-9 and 12 wt. % sodium lauryl sulfate 2EO contained in a high density polyethylene bottle is tested as shown below. The viscosity testing is done with a Brookfield RVTD Viscometer with spindle number 5 at 20 rpm and room temperature. The initial viscosity is 4120 centipoise.

TABLE 2

| Temperature ° C. | Viscosity in Centipoise 2 Weeks | 4 Weeks | 8 Weeks |
|---|---|---|---|
| −18 | 3800 | 4300 | 4700 |
| 4 | 3840 | 4200 | 5020 |
| 25 | 4160 | 4260 | 4940 |
| 43 | 3880 | 4200 | 5340 |
| 49 | 3820 | 4160 | 5400 |

As is observed from this data, the viscosity remained essentially unchanged over a period of four weeks and demonstrated change to a limited degree at a period of eight weeks. This variation is within the accepted range for viscosity.

The pH is measured with a pH meter at 25° C. The initial pH is 5.54 at room temperature. All subsequent pH testing is done at room temperature after holding the composition at a certain temperature for a period of time.

TABLE 3

| Temperature ° C. | pH Measure 2 Weeks | 4 Weeks | 8 Weeks |
|---|---|---|---|
| −18 | 5.80 | 5.54 | 5.46 |
| 4 | 5.78 | 5.59 | 5.54 |
| 25 | 5.77 | 5.43 | 5.35 |
| 43 | 5.77 | 5.35 | 5.09 |
| 49 | 5.76 | 5.30 | 5.09 |

The pH of the composition is maintained within reasonable experimental stability range except at the 8 weeks time frame where at elevated temperature it shows some downward movement. However, the composition is considered to be stable because it is within the acceptable pH range.

Clarity

The composition was put into a 3 cm. diameter round glass bottle and visually tested by the naked eye for clarity over an eight week time period at the second, fourth and eighth week. The composition remained clear in this test.

Triclocarban (TCC) is solubilized in laureth-7 at a weight ratio of 1 to 10 and made up in the same formulation as the previous Example 1 formulation with the same components at the same wt. %, the TCC being 0.5 wt. % of the composition, the laureth-7 being 5 wt % and the sodium lauryl sulfate 2EO at 12 wt. %. The composition is evaluated for stability by viscosity, pH and clarity in the same manner as the prior laureth-9 containing composition. Below are the results.

Viscosity

The initial viscosity of the composition was 10,280 centipoise measured with a Brookfield RTVD Viscometer number 5 spindle at 20 rpm and room temperature. All other viscosity measurements were made at room temperature.

TABLE 4

| | Viscosity - centipoise measured at weeks from initial testing | | |
|---|---|---|---|
| Temperature ° C. | 2 Weeks | 4 Weeks | 8 Weeks |
| −18 | 10,200 | 10,520 | 11,320 |
| 4 | 10,300 | 10,320 | 12,000 |
| 25 | 10,600 | 9,600 | 12,040 |
| 43 | 10,540 | 10,400 | 12,300 |
| 49 | 10,560 | 10,260 | 12,800 |

As shown by the data, the viscosity remains essentially unchanged over a period of four weeks and demonstrated change to a limited degree at a period of eight weeks. This change is within acceptable limitations for viscosity.

The pH is measured with a pH meter is at 25° C. The initial pH is 5.63 at room temperature. All subsequent pH testing is done at room temperature.

TABLE 5

| | pH Measure | | |
|---|---|---|---|
| Temperature ° C. | 2 Weeks | 4 Weeks | 8 Weeks |
| −18 | 5.70 | 5.64 | 5.31 |
| 4 | 5.76 | 5.78 | 5.42 |
| 25 | 5.76 | 5.45 | 5.18 |
| 43 | 5.77 | 5.50 | 5.02 |
| 49 | 5.76 | 5.31 | 4.86 |

As shown by the data, the pH remains essentially unchanged over a period of four weeks and demonstrates change to a limited degree at a period of eight weeks but is within the acceptable pH range.

Clarity

The composition is put into a 3 cm. diameter round glass bottle and visually tested by the naked eye for clarity over an eight week time period at the second, fourth and eighth week. The composition remains clear in this test.

Many other aqueous formulations can be prepared using various other anionic surfactants as a cleansing agent together with other combinations of surfactants if desired. Additionally, various skin feel agents, moisturizers, occlusive agents, and the like, as well as preservatives, colors, humectants, and the like, can be employed. Depending upon the specific composition a greater or lesser quantity of the long-chain primary ethoxylated alcohol can be used to successfully solubilize the carbanilide antibacterial agent.

What is claimed is:

1. An aqueous liquid composition comprising a) an anionic surfactant or mixtures thereof in cleansing effective quantities, b) a primary ethoxylated alcohol of the structure $R(OCH_2CH_2)_nOH$ wherein R is an average alkyl of about 10 to about 14 carbon atoms, inclusive, and n is an average number of about 6 to about 10 in carbanilide stabilizing and solubilizing effective quantities, c) a carbanilide antibacterial agent present in an antibacterial effective amount but no more than about 2 wt. % of the composition, the quantity of component c being in a wt. ratio to component b of about 1 to 6 to about 1 to 15, and d) the balance water.

2. The composition in accordance with claim 1 wherein R is 12 carbon atoms.

3. The composition in accordance with claim 1 wherein n is about 7.

4. The composition in accordance with claim 1 wherein n is about 9.

5. The composition in accordance with claim 3 wherein R is 12 carbon atoms.

6. The composition in accordance with claim 4 wherein R is 12 carbon atoms.

7. The composition in accordance with claim 1 wherein the anionic surfactant is selected from the group consisting of alkyl sulfate, an ethoxylated alkyl sulfate, an alkyl sulfonate, a phosphate, acyl isethionate, and mixtures thereof.

8. The composition in accordance with claim 1 wherein the anionic surfactant is from about 3 to about 30 wt. % of the composition.

9. The composition in accordance with claim 1 wherein the antibacterial agent is triclocarban.

10. The composition in accordance with claim 1 wherein the antibacterial agent is from about 0.1 to about 1.0 wt. % of the composition.

11. The composition in accordance with claim 8 wherein the anionic surfactant is selected from the group consisting of alkyl sulfate, an ethoxylated alkyl sulfate, an alkyl sulfonate, a phosphate, an acyl isethionate, or mixtures thereof.

12. The composition in accordance with claim 11 wherein the antibacterial agent is triclocarban.

13. A solubilized carbanilide composition comprising a carbanilide antibacterial agent and a primary ethoxylated alcohol of the formula $R(OCH_2CH_2)_nOH$ wherein R is an average of about 10 to about 14 carbon atoms, inclusive, and n is an average number of about 6 to 10, wherein the said alcohol is in a wt. ratio to the said antibacterial agent of about 6 to 1 to about 15 to 1.

14. The composition in accordance with claim 13 wherein R is an average of about 12 carbon atoms.

15. The composition in accordance with claim 13 wherein n is an average of 7 or 9.

16. The composition in accordance with claim 13 wherein the antibacterial agent is triclocarban.

17. The composition in accordance with claim 16 wherein R is an average of 12 carbon atoms and n is 7 or 9.

18. The composition in accordance with claim 17 wherein the wt. ratio of the alcohol to the triclocarban is about 7 to 1 to about 12 to 1.

19. The composition in accordance with claim 13 wherein the solubilization occurs at a temperature up to about 50° C.

20. An aqueous liquid composition prepared by mixing a) an anionic surfactant or mixtures thereof in cleansing effective quantities, b) a primary ethoxylated alcohol of the structure $R(OCH_2CH_2)_nOH$ wherein R is an average alkyl of about 10 to about 14 carbon atoms, inclusive, and n is an average number of about 6 to about 10, c) a carbanilide antibacterial agent present in an antibacterial effective amount but no more than about 2 wt. % of the composition, the quantity of component c being in a wt. ratio to component b of about 1 to 6 to about 1 to 15, and d) water.

21. A method for solubilizing a carbanilide antibacterial agent which comprises contacting a carbanilide antibacterial agent with a primary ethoxylated alcohol of the formula $R(OCH_2CH_2)_nOH$ wherein R is an average of about 10 to about 14 carbon atoms, inclusive, and n is an average number of about 7 or about 9, wherein said alcohol is in a weight ratio to the said antibacterial agent of about 6 to 1 to about 15 to 1.

22. The method in accordance with claim 21 wherein carbanilide is triclocarban.

23. The method in accordance with claim 22 wherein the solubilizing occurs up to a temperature of about 50° C.

* * * * *